US005261177A

United States Patent [19]

Armstrong

[11] Patent Number: 5,261,177

[45] Date of Patent: Nov. 16, 1993

[54] FIREARM SAFETY DEVICE

[76] Inventor: Thomas V. Armstrong, 654 W. Warren Dr., Forest Park, Ga. 30050

[21] Appl. No.: 850,499

[22] Filed: Mar. 13, 1992

[51] Int. Cl.[5] ..... F41A 17/02; F41A 17/74

[52] U.S. Cl. ..... 42/70.08; 42/70.11

[58] Field of Search ..... 42/70.08, 70.11, 70.01

[56] References Cited

U.S. PATENT DOCUMENTS

| | | | |
|---|---|---|---|
| 290,867 | 12/1883 | Deyo | 42/70.08 |
| 521,533 | 6/1894 | Campbell | 42/70.08 |
| 835,349 | 11/1906 | Deming | 42/70.08 |
| 4,392,318 | 7/1983 | Daniels | 42/70.11 |
| 4,395,837 | 8/1983 | Durnal | 42/70.11 |
| 4,412,397 | 11/1983 | Bayn | 42/70.11 |
| 4,569,144 | 2/1986 | Thurber | 42/70.11 |
| 4,802,298 | 2/1989 | Baugus | 42/70.11 |
| 4,934,083 | 6/1990 | Smith | 42/70.07 |
| 4,961,277 | 10/1990 | Rosenbaum | 42/70.11 |
| 5,001,854 | 3/1991 | Derman | 42/70.11 |
| 5,010,675 | 4/1991 | Selleck | 42/70.11 |
| 5,016,377 | 5/1991 | Gunning | 42/70.11 |
| 5,020,259 | 6/1991 | Mossberg | 42/70.110 |
| 5,048,212 | 9/1991 | Mossberg | 42/70.11 |
| 5,062,233 | 11/1991 | Brown | 42/70.11 |

FOREIGN PATENT DOCUMENTS

| | | | |
|---|---|---|---|
| 378767 | 12/1922 | Fed. Rep. of Germany | 42/70.11 |

*Primary Examiner*—Stephen M. Johnson

*Attorney, Agent, or Firm*—Hopkins & Thomas

[57] ABSTRACT

A firearm safety device (10) is provided for securing the hammer of a firearm against movement to prevent unauthorized or accidental discharge of the firearm. A rigid base member (25) is fitted about the hammer, and a cable (41), attached to one side edge of the base member (25), is extended about the butt of the firearm. A connector (47) is engaged by a locking means (61) to thus attach the distal end (46) of the cable (41) to the base member (25) and thereby secure the base member (25) about the hammer of the firearm.

21 Claims, 2 Drawing Sheets

FIREARM SAFETY DEVICE

FIELD OF THE INVENTION

The present invention relates in general to safety devices for firearms, and more particularly, to a safety device for temporarily disabling a firearm to prevent unauthorized or accidental discharge thereof.

BACKGROUND OF THE INVENTION

In recent years, the growing popularity of hunting and sport shooting, as well as growing concerns over personal safety, has generated an increase in the ownership of firearms, especially handguns. The possession of firearms does, however, create serious dangers. Increasing numbers of people are being injured or killed by their own guns by accident, as when cleaning the weapon, or by dropping the weapon, thereby causing the weapon to fire accidentally. Additionally, statistics show that gun owners often find their own weapons used against them by intruders who have entered the home and discovered the weapon and are then surprised by the owner, or who manage to disarm the owner.

Perhaps the most serious danger that results from having a loaded weapon in the house is to children. As the number of weapons in the homes keep increasing, more and more children are being killed by guns. Children have little concept of the danger of firearms, often viewing them as a toy. As a result, children are seriously maimed or killed every day because they gained access to a gun and accidentally discharged it while playing, injuring either themselves or others caught in the line of fire.

In efforts to make guns safe for everyone, a number of lock-out devices for rendering a firearm inoperable have been introduced in recent years. For example, U.S. Pat. Nos. 5,016,377, 5,020,259, 5,062,233, and 5,001,854 all disclose locking devices for firearms to prevent unauthorized or accidental discharge. A problem with most such devices is that they require a rod or cable to be extended through the barrel and chamber of the gun and then secured to disable the weapon, making the application and removal of the devices difficult. Additionally, such devices generally prevent loading of the firearm while secured. This renders the firearm substantially ineffective for use as a means of protection, as the lockout device must first be unsecured and then removed from the barrel, and the gun then loaded before it can be used. In an emergency situation, such a delay can render the gun useless.

Other safety devices have been proposed that enable the gun to be at least partially loaded and still be disabled. Examples of such devices include U.S. Pat. Nos. 4,934,083, 4,569,144, and 4,412,397. None of these devices, however, provides a lock mechanism for preventing unauthorized use of the gun, and, while they are supposed to prevent operation of the firearm by a small child, they are typically ineffective for preventing use by older children or intruders who can easily manipulate the lock and remove the device. Further, none of these devices effectively guard against accidental discharge of the firearm when it is dropped and the hammer is struck.

The Bayn Patent No. 4,412,397, discloses a frangible strap designed to prevent movement of the hammer of a gun and thereby prevent the gun from being fired. This strap is, however, designed to be a breakaway device that is pulled free when sufficient force is applied. Such a strap conceivably could be fractured or separated if the hammer were struck with sufficient force, thereby allowing the gun to fire. Additionally, older children and adults can break the strap with relative ease and a small child could easily cut the strap with a pair of scissors, thereby effectively negating any safety effect of such a device.

Therefore, it can be seen that it would be desirable to provide a firearm safety device that disables and prevents discharge of the firearm and that can be locked securely in place, but that is easily and quickly installed and removed and which allows the firearm to remain fully loaded while secured.

SUMMARY OF THE INVENTION

Briefly described, the present invention comprises a firearm safety device that engages and locks the hammer or firing mechanism of a firearm against movement. The device includes a substantially rectangular base member, formed from a strong, rigid material such as steel or fiberglass, which fits about the hammer or firing mechanism of the firearm. An aperture is formed through the base member, approximately through the center thereof. The aperture is a substantially circular opening having a circular contact edge that engages the hammer of the firearm as the base member is fitted over it. A pair of substantially circular cable openings are formed adjacent one side edge of the base member for connecting an attachment means to the base member. The attachment means is typically a cable or strap formed from an inelastic flexible material, such as a steel cable. The cable includes a distal end having a connector attached thereto and a proximal end attached to the base member, and functions to secure the base member in place about the hammer of the firearm. The proximal end of the cable is inserted through a first one of the cable openings, and is looped over and extended through the second cable opening to form a hitch connection with the base member.

Set screws are provided at each cable opening, extending through the base member from the side edge thereof adjacent the cable openings, and projecting into the cable openings. The cable can be adjusted to the required length for securing the base member to the firearm, and the set screws then tightened to engage and fix the cable to the base member.

A pair of lock openings are formed in the base member on the opposite side of the central aperture from the cable openings, and adjacent a side edge of the base member. The lock openings include a first opening that is substantially oval shaped and a second opening that is a substantially U-shaped notch formed in the upper edge of the base member and extending longitudinally, parallel to the side edge of the base member toward the first opening. The shank of a conventional locking means, such as a padlock, is extended through the lock openings to secure the distal end of the cable to the base member.

In the installation of the firearm safety device, the base member is urged onto the hammer until the hammer engages the contact edge of the aperture and further movement of the base member over the hammer is prevented. The cable is then encircled about the butt or handle of the firearm, and through the trigger guard. The connector at the distal end of the cable is placed over the open end of the shank of the lock and the lock is closed. As the lock is closed, the cable is pulled tight and the base member is thereby secured tightly in place about the hammer of the firearm to prevent movement of the hammer and thereby prevent discharge of the firearm.

A cap or cover is also provided, which fits over the hammer and the base plate to provide additional protection for the hammer, guarding against damage thereto from being dropped or struck.

In another embodiment of the invention, the cap has a lock cylinder integrally mounted thereon. In such an embodiment, the cap snugly engages the sides of the base member. Additionally, the connector at the distal end of the cable is formed with a locking pin that is received within and engages the lock cylinder mounted in the cap to secure the base member about the hammer of the firearm.

In still another embodiment of the invention, the cable is replaced with a flat strap or braided band formed from steel or a fiberglass material. In use, one end of the strap is fixed to a side edge of the base member and the free or distal end of the strap is encircled about the butt of the firearm. A clasp means is provided adjacent the side edge of the base member on the opposite side of the aperture formed in the base member from the fixed end of the strap. The clasp means includes a base plate having a channel formed therethrough for receiving the free end of the strap, and a locking member pivotally attached to the base plate.

The locking member has an engaging portion that engages and holds the strap, and a locking arm portion extending from the engaging portion at an angle thereto and having a longitudinally extending slit formed therein. A lock plate is mounted to the base plate extending perpendicular to the base plate and is received through the slit formed in the locking arm as the locking arm is urged toward the base plate to cause the engaging portion to engage and hold the strap. A lock opening is formed in the lock plate, through which the shank of a locking means such as a padlock is extended and secured to lock the clasp, and hence the strap, and thus the firearm safety device, in place to secure the hammer of the firearm against movement.

DETAILED DESCRIPTION OF THE PREFERRED EMBODIMENT

Figure 1:
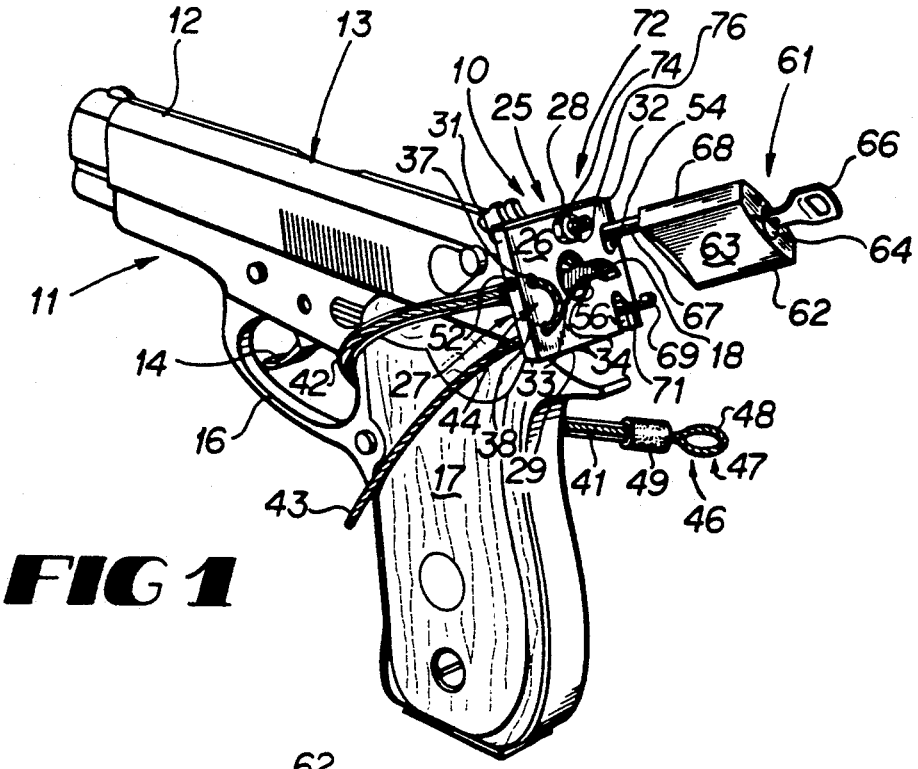
FIG. 1 is a perspective view of a firearm with the firearm safety device attached thereto.

Referring now to the drawings in which like numerals indicate like parts throughout the several views, FIG. 1 illustrates a firearm safety device 10 of the present invention mounted to a firearm 11. The firearm illustrated in FIG. 1 is shown as an automatic pistol or handgun. It will be understood by those skilled in the art, however, that the present firearm safety device 10 can be mounted to other types of firearms such as revolvers and some rifles and shotguns. As shown in FIG. 1, the firearm 11 includes a barrel portion 12, a chamber portion, indicated generally at 13, a trigger 14 with a trigger guard 16 extended thereabout, a slide 15 which reciprocates to load a round into the chamber, a butt or handle portion 17 by which the firearm 11 is gripped and held by a shooter, and a firing mechanism such as a hammer 18. The hammer 18 is linked to the trigger 14 so that as the trigger is urged toward the butt 17, the hammer is moved from a resting position, to a cocking position and then forwardly into a striking position to engage a round (not shown). As the hammer strikes the round, the round is discharged through the barrel 12 and the firearm is fired.

Figure 2:
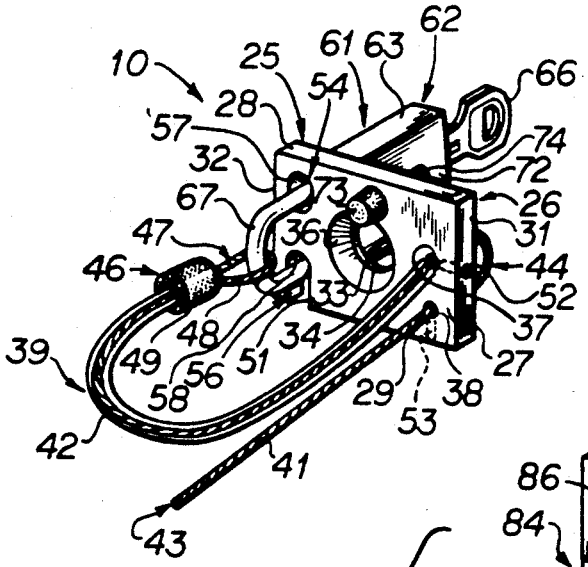
FIG. 2 is a perspective view of the firearm safety device.

As illustrated in FIGS. 1 and 2, the firearm safety device 10 includes a substantially rectangular rigid base member 25 formed from a resilient, unyielding material such as metal (i.e. steel) or fiberglass, and is typically covered with a plastic or polyethylene coating to prevent the base member from scratching or scarring the surface of the firearm 11 (FIG. 1). The base member 25 includes an exposed surface 26 exposed to the shooter, a facing side surface 27, which engages and rests upon the surface of the firearm 11, an upper side edge 28, a lower side edge 29, and left and right side edges 31 and 32.

As illustrated in FIG. 2, an aperture 33 is formed through the base member 25, approximately through the center thereof. The aperture is approximately circularly shaped and has a circular contact edge 34. The aperture is of a diameter sized approximately to receive hammers of various sizes therethrough, such that the firearm safety device 10 can be utilized with a variety of different firearms. A beveled portion 36 is formed about the contact edge 34 of the aperture 33 on the facing side surface 27 of the base member 25. The beveled portion is formed at approximately a 45° angle, which enables the contact edge 34 to engage the hammer 18 (FIG. 1) of any firearm 11 to which it is attached snugly without regard for differences in the sizes of hammers of differing firearms. The aperture 33 of base member 25 is large enough to surround the protruding portion or "spur" of the hammer 18, so that any movement of the base member 25 or the slide 15 usually will not disturb the hammer.

Figure 3:
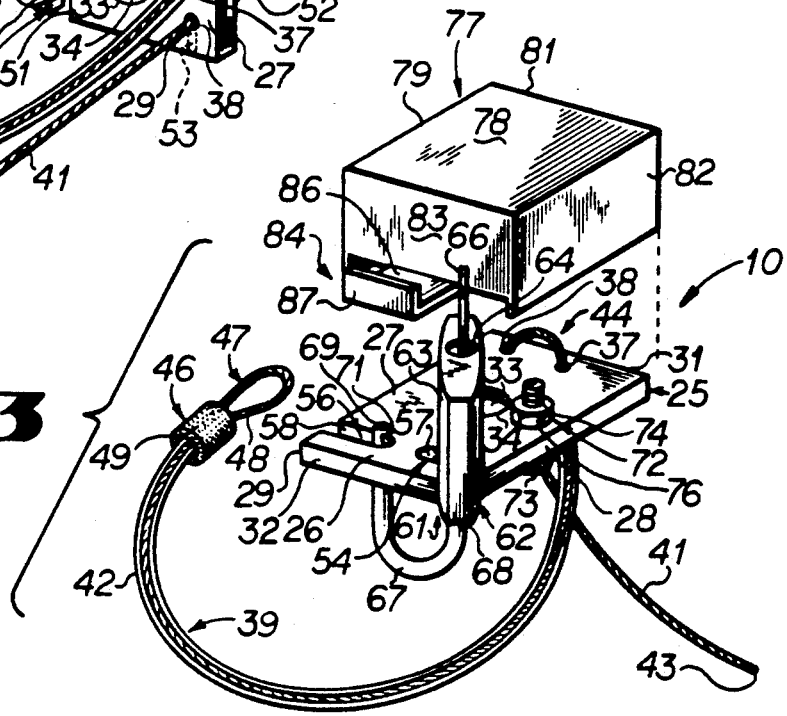
FIG. 3 is an exploded perspective view of the firearm safety device showing the cap fitted thereover.

As FIGS. 2 and 3 illustrate, a pair of cable openings 37 and 38 are formed through the base member 25 adjacent left side edge 31 of the base member. The openings are substantially cylindrical holes formed through the base member and are sized to receive an attachment means 39 therethrough. As shown in FIGS. 2 and 3, the attachment means 39 typically comprises a cable or strap 41 of an inelastic material such as steel or fiberglass. The cable 41 is generally between 8-12 inches in length and is sheathed in a plastic or rubber casing, as indicated at 42, to prevent the cable from scratching or rubbing the finish of the firearm 11 (FIG. 1). As illustrated in FIGS. 2 and 3, the cable 41 includes a proximal end 43 that passes through the first cable opening 37, and is looped over and passed through the second cable opening 38 to form a hitch connection 44 for attaching the cable 41 to the base member 25. The cable further includes a distal end 46 at the opposite end of the cable having a connector 47 attached thereto. As illustrated in FIGS. 2 and 3, the connector is typically a loop 48 formed by the distal end of the cable being looped over and secured by a sleeve connector 49. It will be understood that while a loop connector is shown, other connectors, such as a clasp or an eye-nut, can be utilized as well. As illustrated in FIGS. 1, 2, and 3, the cable 41 is extended in a semicircular fashion from the left side edge 31 of the base member about the butt 17 (FIG. 1)

of the firearm 11, through the trigger guard 16, and back toward the right side edge 32 of the base member 25 to which it is secured to thereby lock the base member in position on the firearm 11.

As shown in FIG. 2, set screws 52 and 53 (indicated in dashed lines) are provided at each of the cable openings 37 and 38. Set screw 52 extends laterally through the base member from the left side edge 31 of the base member into the first cable opening 37. Set screw 53 extends through the base member from the lower side edge 29 of the base member into cable opening 38. The set screws 52 and 53 are each recessed into the base member and include a hexagonal or other formed recess into which a wrench is received for tightening and loosening the set screws. The set screws securely fix the cable at a predetermined set length to fit the particular firearm to which the firearm safety device 10 is attached when the set screws are tightened.

As shown in FIGS. 1 and 2, a pair of lock openings 54 and 56 are formed through the base member 25 on the opposite side of the central aperture 33 from the cable openings 37 and 38, adjacent the right side edge 32 of the base member. First lock opening 54 is generally oval shaped having a beveled edge 57 (FIG. 2) on both the exposed and facing side surfaces 26 and 27 of the base member 25. Second lock opening 56 is typically a substantially U-shaped notch or slot formed in the side edge 28 of the base member and extending toward lock opening 54, parallel to the right side edge 32 of the base member and includes a beveled edge 58 on the facing side surface 27 of the base member. The lock openings 54 and 56 are sized to receive a locking means 61, such as a padlock, therethrough.

As illustrated in FIGS. 1, 2, and 3, the locking means 61 is typically a conventional key padlock 62, although other types of locking means, such as combination locks, can be utilized as well. The padlock includes a housing 63 having a lock cylinder 64 (FIGS. 1 and 3) mounted integrally therein. A key 66 is inserted within and engages the lock cylinder 64 for unlocking the lock. The lock further includes a substantially U-shaped shank 67, biased outwardly from the housing by a spring (not shown), formed from a metal such as case hardened steel, that is movable into and out of the housing 63, as the lock 62 is locked and unlocked. As shown in FIG. 3, the shank 67, includes a fixed end mounted within the housing 63 and a free end 69 having a notched portion 71 at its tip. The free end 69 of the lock is received within the housing 63 and its notched portion engages and is held within the housing by a locking member (not shown) of the lock cylinder to close and lock the lock.

As shown in FIGS. 1 and 3, the free end 69 of the shank 67 of the lock 62 is extended through the first lock opening 54. The connector 47 at the distal end 46 of the cable 41 is received over the second end 69 (FIG. 3) of the shank of the lock. As shown in FIG. 2, the free end of the lock is then swung through the lock opening 56 and is urged to its closed locked position to lock the distal end of the cable to the base member.

As shown in FIG. 3, a jackbolt 72 is threaded through a bore (not shown) found in the base member 25 between the central aperture 33 and the upper side edge 28 of the base member 25. The jackbolt 72 includes a cushion tip 73 (FIG. 2) formed from a compressible soft material such as foam rubber or neoprene. As shown in FIGS. 1 and 3, a bolt shank 74 extends through the base member, projecting away from the exposed side surface 26 of the base member and is attached to the cushion tip. A lock nut 76 is mounted on the bolt shank and can be rotated to lock the jackbolt after adjustment of the position of the cushioning tip 73 (FIG. 3) to adjust the fit of the base member on the firearm 11 (FIG. 1), to prevent the base member from shifting or moving once it is secured about the hammer of the firearm.

As shown in FIG. 3, a cap or cover 77, can be positioned over the base member 25, substantially covering the base member and any exposed portions of the hammer of the firearm that protrude through the central aperture 33 of the base member. The cap includes a top portion 78 and four side walls 79, 81, 82, and 83. As shown in FIG. 3, side walls 79, 81, and 82 are slightly longer than side wall 83. As the cap is positioned over the base member, side walls 79, 81, and 82 overlap the upper and lower side edges 28 and 29 and the left side edge 31 of the base member 25, engaging these edges in tight frictional engagement to hold the cap 77 on to the base member. A tongue 84 is attached to side wall 83 and extends away from side wall 83 toward the right side edge 32 of the base member. The tongue 84 includes a substantially flat horizontally extending portion 86 extending parallel to the exposed side surface 26 of the base member and a vertically extending flange 87 attached to the end of the flat portion 86 of the base member. The tongue is positioned between the lock openings 54 and 56 and thus is extended between the fixed and free ends 68 and 69 of the shank 67 of the lock 62. The flat portion 86 of the tongue 84 is engaged by the lock housing 63 as the lock is closed and locked to further secure the cap to the exposed top surface of the base member.

OPERATION OF THE PREFERRED EMBODIMENT

As shown in FIG. 1, the firearm safety device 10 is installed about the hammer 18 and butt or handle portion 17 of a firearm 11 to temporarily disable the firearm and prevent unauthorized or accidental discharge of the firearm. The base member 25 of the firearm safety device 10 is positioned over the hammer 18 of the firearm 11, with the hammer aligned with the aperture 33 formed centrally through the base member. The base member is urged onto the hammer, with the hammer received through the aperture 33. The beveled portion 36 (FIG. 2) of the contact edge 34 on the facing side surface 27 of the base member contacts and frictionally engages the hammer as the base member is urged onto the hammer. The base member is urged onto the hammer until further movement of the base member onto the hammer is resisted by the engagement of the hammer by the contact edge of the aperture. The cushion tip 73 at the end of a jackbolt 72 mounted to the base member 25 adjacent the upper side edge 28 thereof is pressed against and cushions the base member against the rear of the firearm 11 (FIG. 1). The position of the jackbolt is adjusted by tightening or loosening a nut 76 positioned about the shank 74 of the jackbolt 72 to stabilize and prevent the base member from shifting or wobbling once it is positioned about the hammer.

The proximal end 43 of a cable 41 is threaded through a first cable opening 37 formed adjacent the left side edge 31 of the base member 25. As indicated in FIG. 1, the distal end 46 of the cable 41 is then encircled about the butt 17 of the firearm 11, passing through the trigger guard 16 and forming a semicircle about the butt 17 of the firearm 11. The length of the cable is adjusted by pulling excess cable through the first cable opening 37 to adjust the cable to a length whereby the connector 47 at the distal end of the cable is positioned immediately adjacent the facing side surface 27 of the base member 25 at the right side edge 32 of the base member, as indicated in FIGS. 2 and 3. Thus, the cable 41 is sized to the correct length to fit the particular firearm to which the firearm safety device 10 is to be mounted.

As shown in FIG. 2, once the cable 41 has been sized to the proper length to fit the firearm to which the firearm safety device 10 is to be attached, the proximate end 43 of the cable 41 is then looped over and threaded through the second cable opening 38 to thereby form a hitch connection 44 between the cable 41 and the base member 25. Set screws 52 and 53 are then tightened against the cable to thereby secure the cable to the base member with its length fixed as desired.

As shown in FIG. 1, after the proximate end of the cable has been secured to the base member 25 adjacent the left side edge 31 of the base member, and the distal end 46 of the cable 41 is then encircled about the butt 17 of the firearm 11, passing through the trigger guard 16, the open end 69 (FIGS. 1 and 3) of lock 62 is inserted through the first lock opening 54 and extended in a direction parallel to the facing side surface 27 of the base member. The connector 47 at the distal end of the cable is placed about the open end 69 of the shank 67 of lock 62. As shown in FIGS. 2 and 3, open end of the lock is then pivoted through the second lock opening 56 and is aligned with its opening in the lock housing and is urged into the housing 63 of the lock 62 to engage the lock cylinder 64 (FIG. 3), thereby closing and locking the lock.

As FIG. 2 illustrates, the locking of the lock 62 secures the distal end of the cable to the base member adjacent the right side edge 32 of the base member in order to secure the base member and place about the hammer 18 (FIG. 1) of the firearm. Additionally, as the lock is closed and locked, it tends to pull the cable taught about the butt of the firearm to secure the base member tightly against the firearm and restricts the base member from shifting or moving. The slide 15 will be prevented from moving rearwardly by the cable 41, thereby preventing the inadvertent loading of a round in the chamber.

As shown in FIG. 1, once so secured in place, the hammer 17 of the firearm 11 is engaged and fixed in place by the contact edge of the aperture of the base member, thereby preventing any movement of the hammer. As a result, the hammer is fixedly secured and cannot move between cocking and firing positions to discharge a round from the firearm. Thus, even if the firearm is dropped or the hammer is struck with great force, or if the trigger is pulled, the hammer cannot be moved and therefore a round cannot be discharged from the firearm. Consequently, the firearm can remain fully loaded while the firearm safety device 10 is secured thereto without danger of accidental or unintentional discharge of the firearm.

To remove the firearm safety device, the key 66 is inserted into the lock cylinder 64 to unlock the lock 62, releasing the free end 69 of the lock shank from the lock housing 63. The connector 47 of the cable 41 is removed from the lock shank and the base member 25 is urged off of the hammer 18 (FIG. 1) of the firearm, pulling the cable from about the butt of the firearm to enable the firearm for use.

Additionally, as shown in FIG. 3, a cap 77 can be positioned over the base member 25 to protect the base member and the exposed portion of the hammer. To install the cap, a cap is positioned over the exposed side surface 26 of the base member 25 and is pressed down onto the base member, with three of the sidewalls, 79, 81, and 82 engaging the left side edge 31 and the upper and lower side edges 28 and 29 of the base member 25 in tight frictional engagement to secure the cap to the base member. A tongue portion 84 extends laterally away from side wall 83 of the cap and extends between the first and second lock openings 54 and 56 adjacent the right side edge 32 of the base member. As the lock 62 is swung closed and locked, the tongue 84 projects between the fixed and free ends 68 and 69 of the lock 62 and is engaged between the housing 63 of the lock 62 and the exposed side surface 26 of the base member 25 to further secure the cap to the base member 25. Thus, the cap 77 protects the firearm safety device 10 and the hammer of the firearm from damage due to being dropped or struck, and provides added security to prevent access to the hammer and protects the hammer from being struck or impacted.

DESCRIPTION OF ADDITIONAL EMBODIMENT

Figure 4:
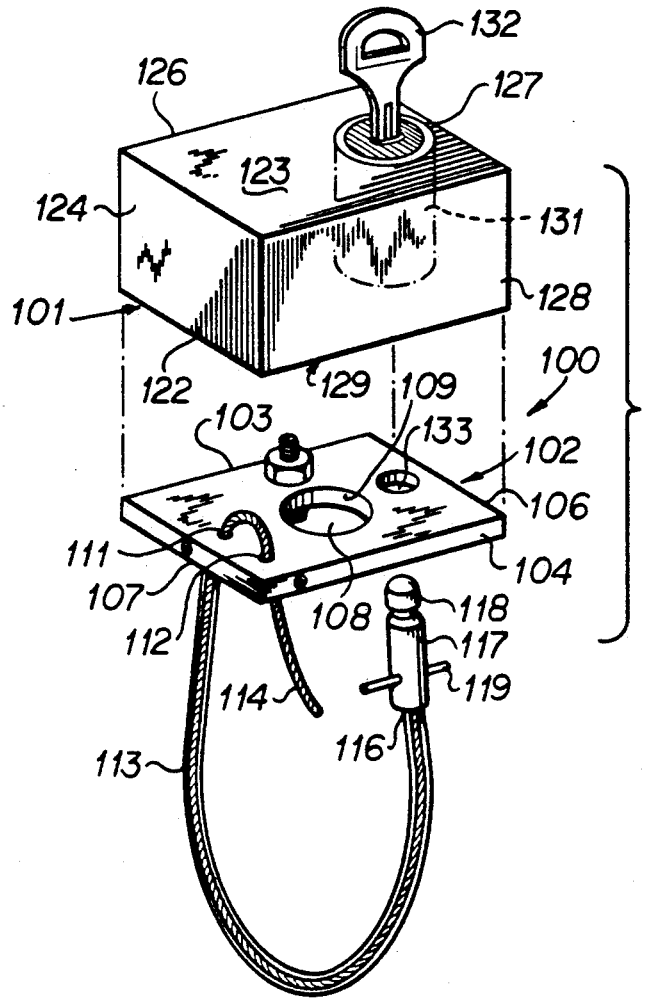
FIG. 4 is an exploded perspective view of an additional embodiment of the firearm safety device.

FIG. 4 illustrates a second embodiment of the firearm safety device 100, showing an alternative locking means 101. In this embodiment, the firearm safety device includes a base member 102 having side edges 103 and 104 and right and left side edges 106 and 107. As shown in FIG. 4, a substantially circular aperture 108 is formed approximately through the center of the base member 102 and has a substantially circular contact edge 109. A pair of side openings 111 and 112 are formed adjacent the left side edge 107 of the base member 102, and receive a cable 113, or similar attachment means, therethrough for attaching a proximal end 114 of the cable 113 to the base member 102 adjacent the left side edge 107 of the base member. The opposite or distal end 116 of the cable 113 has attached thereto a locking pin 117 having a notched end portion 118 for engaging the locking means 101. A finger bar 119 is extended through the lock pin 117 between the notched end 118 of the lock pin and the distal end 116 of the cable 113, and provides a means for grasping and holding the locking pin 117 as the locking pin is engaged by the locking means 101.

As illustrated in FIG. 4, the locking means 101 comprises a substantially rectangular cap 122 formed from a fiberglass, plastic, or other suitable material and sized to receive and engage the upper, lower, right, and left side edges 103, 104, 106, and 107 of the base member in tight frictional engagement to secure the cap 122 to the base member 102. The cap includes a top 123, four side walls 124, 126, 127, and 128 and an open-ended bottom portion indicated generally at 129. A lock cylinder 131, shown in phantom, is integrally mounted within the cap 122 and includes a key 132 for unlocking the cylinder.

As shown in FIG. 4, a substantially circular lock pin opening 133 is formed through the base member 102 and receives the notched end 118 of the locking pin 117 therethrough for engagement with the lock cylinder 132, which is aligned approximately with the lock pin opening 133 and receives the notched end 118 of the locking pin 117, engaging and securing the locking pin 117 within the cap to lock the distal end 116 of the cable 113 to the base member 102.

In installation of the firearm safety device 100 to a firearm, the base member 102 is placed about the hammer of the firearm, with the hammer extending through the aperture 108 in the same manner as the embodiment of FIG. 1. The distal end 116 of the cable 113 is there encircled about the butt of the firearm, passing through the trigger guard thereof. The locking pin 117 grasped and held by its finger bar 119 and is urged through the lock pin opening 133 in base member 102. This causes the cable to be pulled taut about the butt of the firearm to secure the base member tightly against the rear of the firearm and about the hammer.

The cap 122 is thereafter positioned over and snapped onto the base member with the notched end 118 of the locking pin 117 being received within and engaged by the lock cylinder 131 to lock the distal end 116 of the cable 113 to the base member 102. As a result, the firearm safety device is securely attached about a firearm with the contact edge of the aperture engaging and fixing the hammer securely in place to thereby prevent movement of the hammer between cocking and firing positions. Thus, the firearm is temporarily disabled and unauthorized or accidental discharge of the firearm is thereby prevented, primarily because the hammer of the firearm cannot be moved.

To remove the firearm safety device, the key 132 is inserted into the lock cylinder and turned, thereby releasing the locking pin 117 from the lock cylinder. The locking pin is then pulled free of the lock pin opening 133 and the base plate is lifted off the hammer of the firearm, pulling the distal end of the cable back through the trigger guard to allow for quick and ready enabling of the firearm for use.

DETAILED DESCRIPTION OF SECOND ADDITIONAL EMBODIMENT

Figure 5:
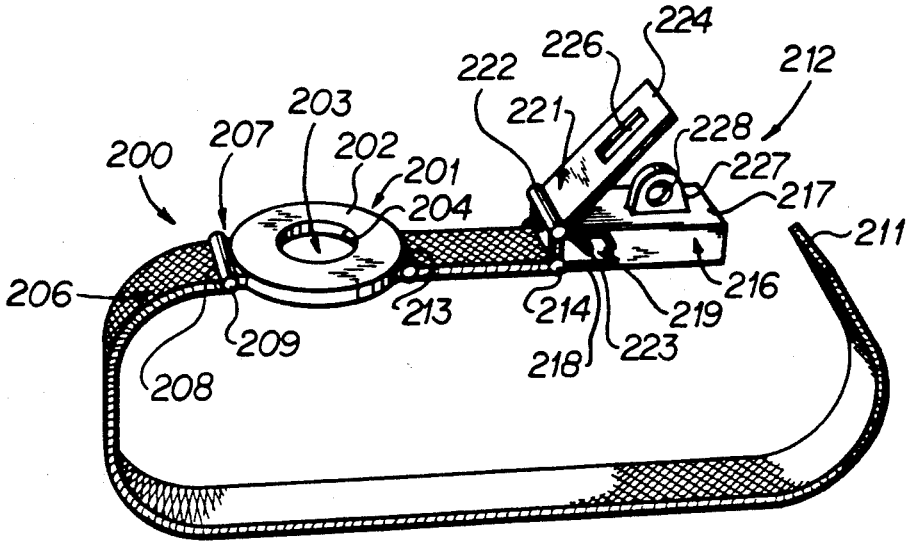
FIG. 5 is a perspective view of another additional embodiment of the firearm safety device.

FIG. 5 illustrates a second additional embodiment of a firearm safety device 200 for securing and immobilizing the hammer of a firearm. In this additional embodiment, the firearm safety device 200 is provided with a base member 201, which is illustrated as being a substantially rounded plate 202, having an aperture 203 formed therein. The aperture 203 is a substantially circular opening formed through the base member 201 approximately in the center of the base member, and has a circular contact edge 204. The base member is positioned about the hammer (not shown) of the firearm with the hammer extending through the aperture 203 and engaging the contact edge 204 for locking the hammer in a fixed and movable position, as with the embodiments of FIGS. 1 and 4.

A braided or woven band or strap 206 is pivotally attached to the base member 201 on the left side of the base member, as indicated generally at 207 in FIG. 5. The strap 206 is typically formed from a flexible, resilient material such as braided steel or a fibrous material such as fiberglass or nylon that resists stretching and which cannot be easily cut or broken. The strap 206 has a fixed end 208 that is pivotally connected to the left side of the base member 201 by a hinge pin 209. This pivotal connection enables the strap to swing or pivot about the left side of the base member 201. As shown in FIG. 5, the strap 206 further includes a free or distal end 211 at the opposite end of its length.

As illustrated in FIG. 5, a clasp means is pivotally attached to the right side 213 of the base member 201 by a hinge pin 214 to enable the clasp means to pivot and move about the right side of the base member. The clasp means 112 includes a hollow clasp member 216 having an upper section 217 and a lower section 218. A channel 219 is formed between the upper and lower sections of the clasp plate and is sized to receive the free end 211 of the strap 206 therethrough. A locking member 221 is pivotally attached to the clasp member 216 by pivot pin 222 to enable the locking member to pivot about the upper section 217 of the clasp member 216. The locking member has an engaging portion 223, preferably toothed, which extends partially into the channel 219 formed through the clasp member 216 and which engages and holds the strap against rearward movement out of the channel, with the strap extending partially through the channel 219. A locking arm portion 224 extends away from the engaging portion 223 of the locking handle at an angle of somewhat less than 90°, and is attached to the engaging portion adjacent the pivot pin 222. A longitudinally extending slit 226 is formed along the length of the locking arm 224.

As FIG. 5 illustrates, a lock plate 227 is attached to and extends upwardly away from the upper section 217 of the clasp member 216. The lock plate is a substantially rectangularly shaped protrusion having an approximately circularly shaped lock opening 228 formed along its length for receiving a locking means therethrough and is aligned with the slit 226 formed in the locking arm 224. A locking means is received through the lock opening 228 of the lock plate to secure the firearm safety device.

In the installation and use of the firearm safety device, the base member 201 is positioned about the hammer of a firearm (not shown) with the hammer extending through the aperture 203 formed in the base member 201. The base member is urged downwardly onto the hammer, toward the rear of the firearm until the circular contact edge 204 of the aperture engages the hammer and further movement of the base member onto the hammer is retarded. The free end 211 of the strap 206 is threaded through the trigger guard of the firearm and encircled about the butt of the firearm and pulled toward the clasp means 212 at the right side 213 of the base member 201. As indicated in FIG. 5, the free end of the strap is fed through the channel 219 formed between the upper and lower sections 217 and 218 of the clasp plate 216 and is pulled taut to secure the base member in place about the hammer of the firearm. Thereafter, the locking arm 224 of locking means 221 is urged downwardly toward the upper section 217 of the clasp member 216, with the lock plate 227 passing through the slit 221 in the locking arm 224.

As the locking arm is urged toward the upper section 217 of the clasp member 216, the engaging portion 223 of the locking member is pivoted toward the lower section 218 of the clasp member and into engagement with the upper surface of the strap. The engagement of the strap by the engaging portion of the locking member secures the strap in place and prevents any rearward movement of the strap out of the channel through the clasp plate to thereby securely lock the firearm safety device 200 in place about the hammer of a firearm.

Once the strap has been so secured, the shank of a conventional locking means (not shown) such as a padlock or combination lock is received through the lock opening 228 of the lock plate 227 and the lock is closed and locked to thereby prevent the locking arm 224 from being lifted or manipulated in any way that could release the engaging portion of the locking handle from the strap. The strap is thus locked securely in place to secure the firearm safety device about the hammer of the firearm. The hammer of the firearm is engaged by the contact edge of the aperture of the base member to thereby securely fix the hammer in place and prevent any movement of the hammer to prevent accidental or unauthorized discharge of the firearm.

To remove the firearm safety device 200, the lock is simply unlocked and removed from the lock opening of the clasp member 216 lock plate and the locking arm urged upwardly away from the upper section 217 to pivot the engaging portion toward the upper section 218, out of engagement with the strap to thereby release the strap 206. The strap is then pulled free of the clasp plate and from about the butt of the firearm, and the base member is urged from about the hammer of the firearm to quickly and easily clear the firearm for use.

While the present invention has been disclosed generally for use with a firearm having a hammer projecting from the rear of the firearm, the present invention is also applicable to "hammerless" firearms or firearms for which the hammer has been filed down or removed. In use on such a firearm, the base plate is positioned at the rear of the firearm over the firing mechanism of the firearm, and the attachment means is tightly secured about the butt of the firearm and is secured in similar fashion to the embodiments illustrated in FIGS. 1, 4, and 5. The tight fit of the cable about the butt of the firearm secures the base member in place over the firing mechanism. This prevents the firing mechanism from moving between resting, cocking, and firing positions to thereby prevent unauthorized or accidental discharge of the firearm.

It will be further understood that the foregoing relates only to preferred embodiments of the present invention. It will be understood by those skilled in the art that numerous changes and modifications can be made to the described embodiments of the invention without departure from the spirit and scope of the invention.

I claim:

1. A firearm safety device for temporarily disabling a firearm in which the firearm has a hammer for striking and firing a cartridge, a trigger for actuating the hammer, and a fixed portion adjacent the trigger, said safety device comprising:

first means for immobilizing the hammer comprising a substantially rigid base member having an aperture formed therein for receiving the hammer of the firearm;

second means for attaching said first means to the firearm with the hammer thereof in said aperture, said second means comprising a flexible member having a proximal end adjustably attached to said base member for adjustably attaching said flexible member to said base member and a distal end;

means for adjustably attaching said proximal end to said base member; and means for releasibly attaching said distal end to said base member;

whereby when said first means is in place with the hammer extending through said aperture and said flexible member is extended about the fixed portion of the firearm and attached to said base member, to secure said base member about the hammer so that the hammer of the firearm is immobilized.

2. A firearm safety device as claimed in claim 1 wherein said means for adjustably attaching said proximal end comprises first and second holes in said base member therein for receiving said proximal end of said flexible member, and said flexible member is releasibly held in said holes.

3. A firearm safety device as claimed in claim 1 wherein said distal end of said flexible member has a connector affixed thereto.

4. A firearm safety device as claimed in claim 3 wherein said means for attaching said distal end to said base member comprises means for receiving and holding said connector.

5. A firearm safety device as claimed in claim 4 wherein said means for receiving comprises a padlock.

6. A firearm safety device as claimed in claim 4 wherein said means for receiving said connector comprises a lock cylinder having means for engaging said connector.

7. A firearm safety device for temporarily disabling a loaded firearm having a barrel through which a round is discharged, a firing mechanism for striking and firing the round, a trigger linked to the firing mechanism for moving the firing mechanism between cocking and firing positions and a fixed portion adjacent the trigger, comprising:

a base member adapted to be positioned about the firing mechanism of the firearm and having an aperture formed therethrough for receiving the firing mechanism of the firearm;

attachment means having a proximal end adjustably attached to said base member adjacent a side edge of said base member and having a distal end spaced from said proximal end and having a connector for securing said base member about the firing mechanism of the firearm; and means for locking said connector of said attachment means to said base member;

whereby said base member is positioned about the firing mechanism of the firearm and the attachment means is extended about the fixed portion of the firearm and said connector is engaged by said means for locking said connector to said base member to thereby secure said base member to the firearm and thus secure the firing mechanism against movement.

8. The firearm safety device of claim 7 and wherein said means for locking comprises a key lock.

9. The firearm safety device of claim 7 and wherein said attachment means comprises a flexible cable formed from a metal material.

10. The firearm safety device of claim 7 and further including a cap to be positioned over said base member for covering said base member and the firing mechanism of the firearm.

11. The firearm safety device of claim 7 and wherein said aperture includes a contact edge having a beveled portion for engaging the firing mechanisms of firearms of varied sizes and securing the firing mechanisms against movement.

12. The firearm safety device of claim 7 and further including a jackbolt having a bolt shank extending through said base member with a cushion tip attached thereto and positioned on a facing side surface of said base member engaging the firearm, for cushioning said base member in position about the firing mechanism of the firearm.

13. A safety device for securing a firing mechanism for a firearm against actuation to prevent discharge of the firearm, comprising:

a substantially rigid base member adapted to engage the firearm adjacent the firing mechanism thereof;

means for attaching said base member about the firing mechanism of the firearm, said means having one end adjustably mounted to said base member and an opposite end adapted to releasibly engage said base member; and locking means for releasibly engaging and locking said opposite end of said means for attaching to said base member to thereby secure said base member to the firearm adjacent the firing mechanism of the firearm;

whereby after said base member is placed in engagement with the firearm, said means for attaching said base member is extended about the firearm and adjusted to attach said base member into tight engagement with the firearm when said opposite end of said means is locked to said base member to secure the firing mechanism of the firearm against actuation.

14. The safety device of claim 13 and further comprising an aperture formed through said base member, with said aperture including a contact edge having a beveled portion for engaging a hammer of the firing mechanism and securing the hammer against movement.

15. The safety device of claim 13 and wherein said locking means comprises a key lock.

16. Apparatus for securing a firing mechanism for a firearm, comprising:

a substantially rigid base member for engaging the firing mechanism of the firearm having at least a first opening formed therethrough;

attachment means for securing said base member to the firearm, said means having a proximal end received through said first opening and attached to said base member, and a distal end;

connector means mounted to said distal end of said attachment means for releasibly attaching said distal end of said attachment means to said base member; and means for locking said connector means to secure said distal end of said attachment means to said base member for securing said base member against the firing mechanism of the firearm to secure the firing mechanism against movement.

17. The apparatus of claim 16 and further including a set screw projecting into said first opening for fixing said attachment means to said base member.

18. The apparatus of claim 16 and wherein said means for locking comprises a lock cylinder having means for receiving said connector means.

19. The apparatus of claim 16 and wherein said connector means comprises a loop connector at said distal end of said attachment means.

20. The apparatus of claim 16 and further comprising an aperture formed through said base member for receiving the firing mechanism therethrough.

21. The apparatus of claim 20 and wherein said aperture includes a contact edge having a beveled portion for engaging the firing mechanism.

* * * * *